US005368229A

United States Patent [19]

Hayes et al.

[11] Patent Number: 5,368,229

[45] Date of Patent: Nov. 29, 1994

[54] IN GROUND POP-UP SPRINKLER WITH ABOVE GROUND HOSE CONNECTION

[75] Inventors: Jerry R. Hayes; Lawrence P. Heren, both of East Peoria, Ill.

[73] Assignee: L. R. Nelson Corporation, Peoria, Ill.

[21] Appl. No.: 77,630

[22] Filed: Jun. 17, 1993

[51] Int. Cl.[5] ..... B05B 3/04

[52] U.S. Cl. ..... 239/69; 239/70; 239/268; 239/269; 239/242; 239/276

[58] Field of Search ..... 239/69, 70, 237, 240–242, 239/200–207, 273, 276, 266–269

[56] References Cited

U.S. PATENT DOCUMENTS

| | | | |
|---|---|---|---|
| 2,573,786 | 11/1951 | Brodbeck et al. | 239/276 |
| 2,706,134 | 4/1955 | Wilson et al. | 239/269 |
| 3,006,558 | 10/1961 | Jacobs | 239/276 |
| 3,021,078 | 2/1962 | Nickell | 239/276 |
| 3,263,930 | 8/1966 | Friedmann et al. | 239/206 |
| 3,521,822 | 7/1970 | Friedmann et al. | 239/241 |
| 3,637,139 | 1/1972 | Felix | 239/206 |
| 3,921,910 | 11/1975 | Hayes et al. | 239/205 |
| 3,929,288 | 12/1975 | Brusadin et al. | 239/276 |
| 4,353,506 | 10/1982 | Hayes | 239/206 |
| 4,856,823 | 8/1989 | Heren | 285/81 |
| 4,858,827 | 8/1989 | Fletcher et al. | 239/69 |
| 4,892,252 | 1/1990 | Bruninga | 239/205 |
| 5,020,722 | 6/1991 | Wardell | 239/276 |
| 5,050,801 | 9/1991 | Ferrari | 239/276 |

*Primary Examiner*—Karen B. Merritt

*Attorney, Agent, or Firm*—Cushman, Darby & Cushman

[57] ABSTRACT

A pop-up sprinkler assembly for installation within the ground and for manual connection from a position above ground with an above ground hose as a source of water pressure. The pop-up sprinkler assembly includes a housing structure having an annular opening and exterior suitable for installation within the ground in a fixed operative position. The housing structure has a inlet passageway communicating with the annular opening. A hose connector is in the passageway for connection to an above ground hose. A sprinkler head is mounted in the annular space that is generally at ground level when the sprinkler head is in a lower storage position. An annular seal is provided between the sprinkler head and the housing structure so that the communication of water pressure with the annular space results in water pressure-biased movement of the sprinkler head from the lower storage position to a raised operative position. The sprinkler has an outlet for directing water under pressure outwardly thereof onto the ground in a predetermined pattern.

22 Claims, 6 Drawing Sheets

Fig. 4.
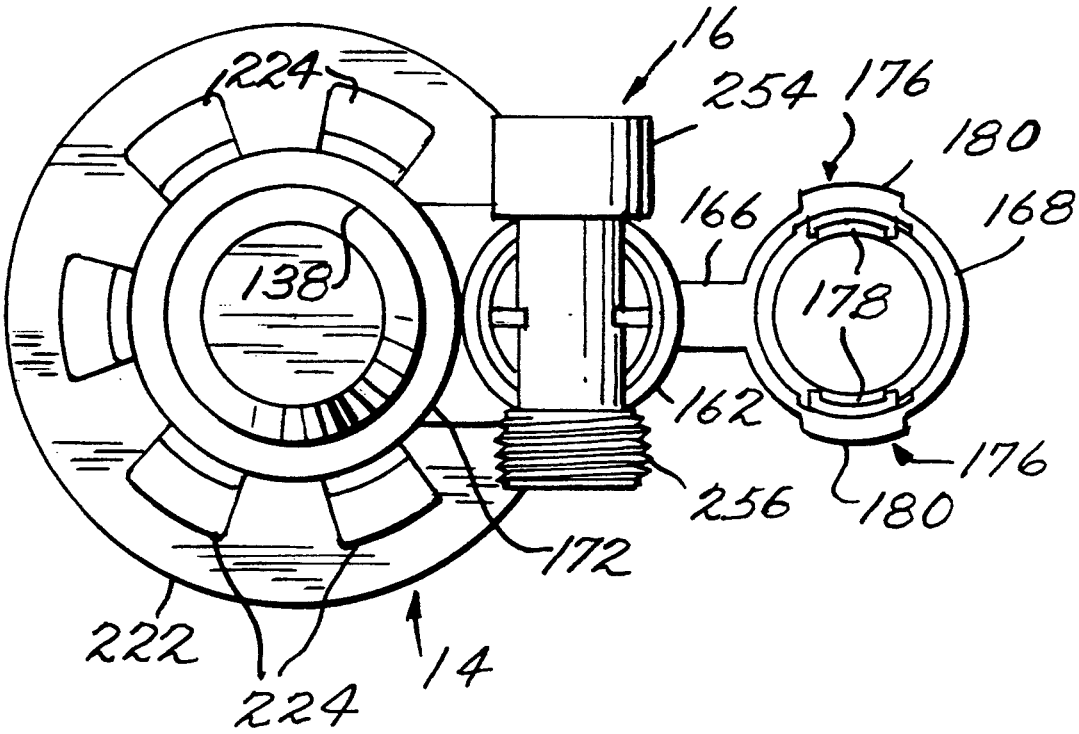
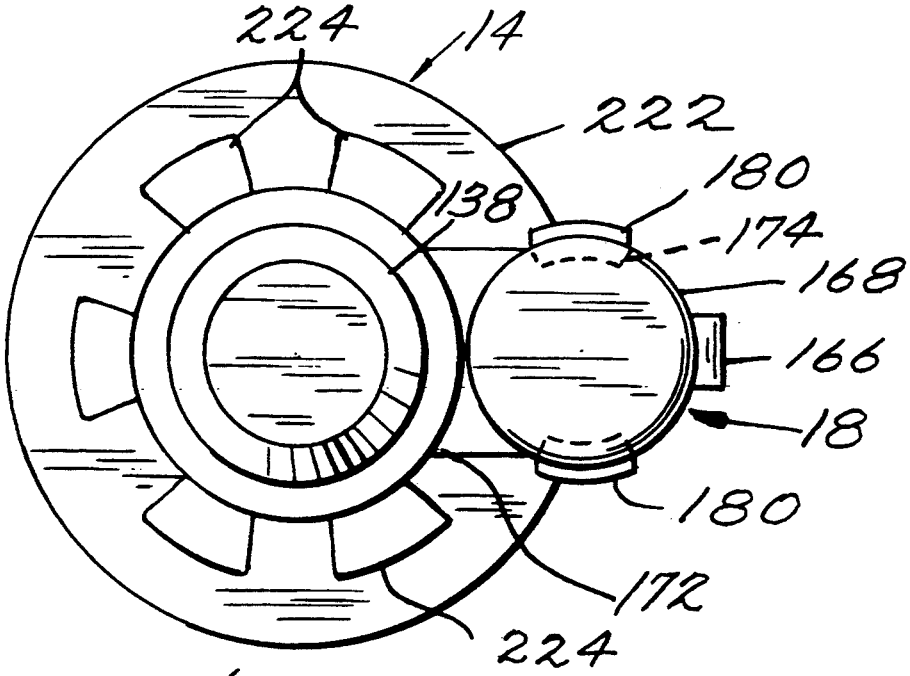
Fig. 5.

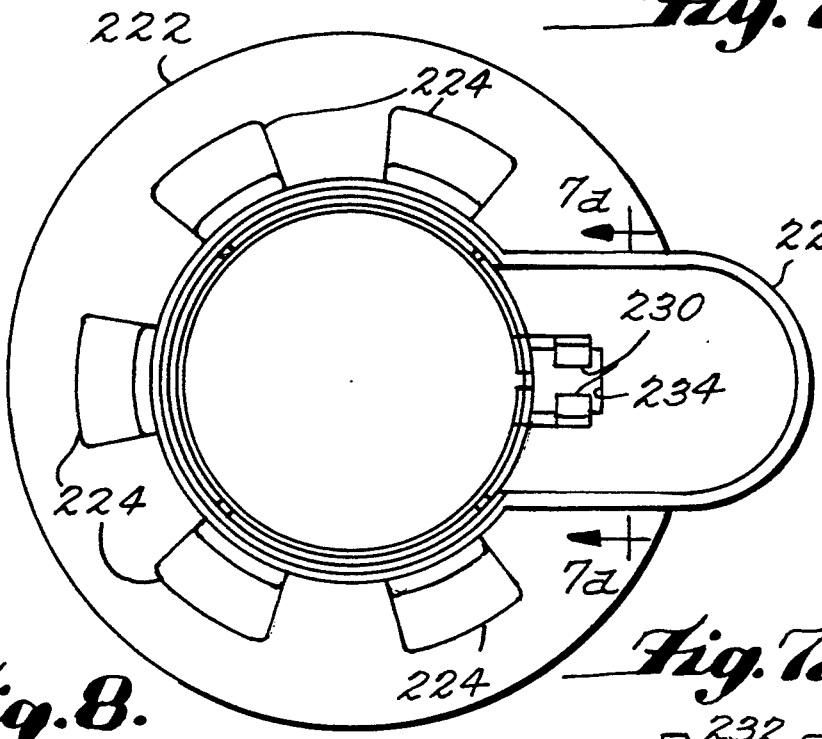
Fig. 7.
Fig. 7a.
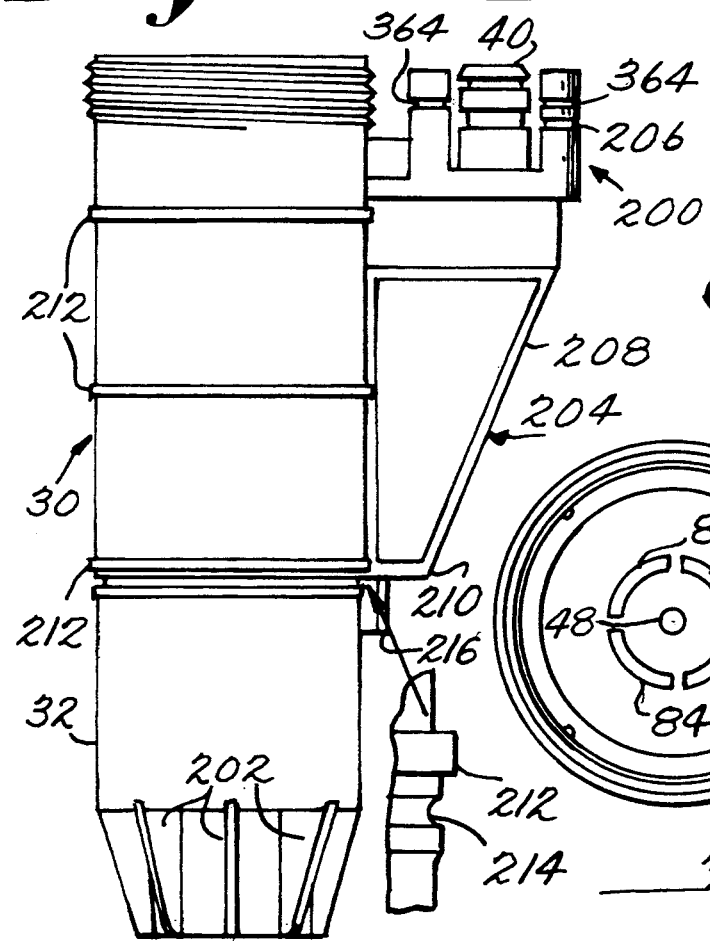
Fig. 8.
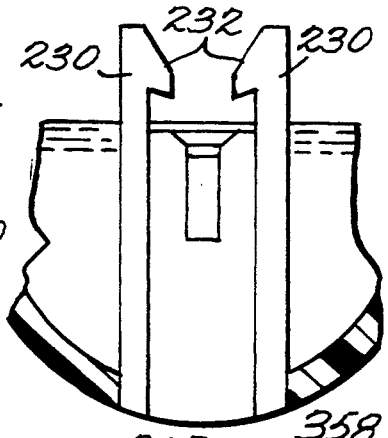
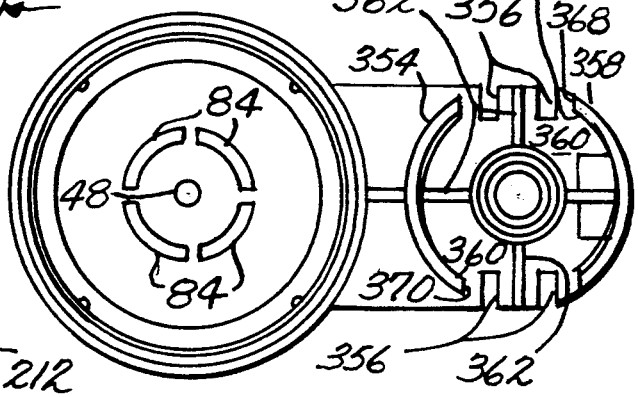
Fig. 9.

IN GROUND POP-UP SPRINKLER WITH ABOVE GROUND HOSE CONNECTION

This invention relates to pop-up sprinkler assemblies for installation within the ground and more particularly to pop-up sprinkler assemblies adapted for manual connection with an above ground hose as a source of water pressure.

There are generally two types of water sprinklers. The first type of water sprinkler is an above ground sprinkler which can be of the oscillating type, rotary type and step-by-step rotary type, among others. All of these types are well known in the prior art. These sprinklers are simply connected to one end of a hose, with the other end of the hose connected to a sill cock. These sprinklers all offer the major advantage of low purchase cost.

One source of difficulty encountered with above ground sprinklers is the limited coverage area provided by a single sprinkler. Even with multiple sprinklers it is frequently necessary to have to repeatedly move the sprinklers from place to place to cover the entire lawn. Because of this difficulty, the usual alternative is to forget about sprinkling until the lawn is in danger of dying due to lack of water. All too often such sprinkling is either ineffective or too late. Another difficulty is that incorrect placement of the sprinkler results in either overwatering or underwatering of various areas on the lawn.

The second type of water sprinkler is the underground sprinkler. A typical system consists of a series of pop-up sprinklers which are embedded in the ground at appropriate positions throughout the lawn area to be sprinkled. Usually the heads are divided into several watering areas embodying one or more than one sprinkler head, depending upon their capacity and the capacity of the water source available. The usual pop-up sprinkler includes a housing assembly adapted to be stationarily mounted in the ground and to be connected at its lower end with an in-ground supply pipe through which a controllable source of water under pressure is communicated with the housing assembly. Examples of pop-up sprinkler assemblies are shown in U.S. Pat. Nos. 4,892,252, 4,353,506 and 3,921,910.

The underground sprinkler systems offer many advantages over the above ground system. A major advantage is that there is complete lawn coverage by embedding the sprinklers into the ground at appropriate positions throughout the lawn area to be sprinkled. These systems are frequently automated in that various watering zones can be turned on and off in accordance with a selected program. This ease of operation usually results in correct sprinkling of all areas of the lawn. However, the high cost of burying underground supply pipes severely restricts their utilization. This is especially true in areas where the yearly rainfall is usually sufficient to maintain lawn growth. Additionally, once the supply pipes are buried, it is difficult and expensive to change location of the pop-up sprinklers, if ever required.

In summary, it can be stated that above ground sprinklers have the advantage of low cost and essentially cost free installation with the disadvantage of the need for frequent manual operating movements and seasonal storage. Whereas, underground sprinklers require no operative movements or seasonal storage but are quite costly to purchase and install.

Accordingly, it is an object of the present invention to provide a pop-up sprinkler assembly for installation within the ground and for manual connection from a position above ground with an above ground hose as a source of water under pressure which obtains in large measure the advantages of both the above ground sprinkler and the in-ground sprinkler systems while eliminating in large measure the disadvantages of both. In accordance with the principles of the present invention, this object is obtained by providing a housing structure having an interior defining an annular space terminating at an upper end thereof with an annular opening and an exterior suitable to enable the housing structure to be installed in the ground in a fixed operative position wherein the annular opening is disposed generally at ground level with the annular space extending therebelow. The housing structure provides an inlet passageway that communicates with the annular space below the annular opening. The inlet passageway extends from the annular space into an access position spaced laterally from the annular opening. A hose connector is connected to the passageway in a position allowing manual access thereto from above ground for enabling an above ground hose to be manually connected therewith from a position above ground so as to communicate a source of water under pressure within the hose with the passageway an the annular space. The sprinkler head is mounted in the annular space for spring-biased movement with respect thereto into a lower storage position and for water pressure-biased movement from the lower storage position into a raised operative position. The sprinkler head has an upper end portion disposed within the annular opening generally at ground level when the sprinkler head is in the lower storage position. An annular seal between the interior of the housing structure and the exterior of the sprinkler head provides a seal for the annular space at a position above the communication of the passageway therewith so that the communication of water under pressure with the annular space results in the water pressure-biased movement of the sprinkler head from its lower storage position into its raised operative position. The sprinkler head has an inlet communicating with the water under pressure within the annular space and an outlet communicating with the inlet, the outlet being disposed in the upper end portion of the sprinkler head so as to be positioned above ground level when the sprinkler head is in the raised operative position for directing water under pressure outwardly thereof onto the ground in a predetermined pattern.

Another object of the present invention is the provision of a sprinkler system of the type described which is simple in construction, effective in operation and economical to manufacture.

These and other objects of the present invention will become more apparent during the course of the following detailed description and appended claims.

The invention may best be understood with reference to the accompanying drawings, wherein an illustrative embodiment is shown.

Figure 2:
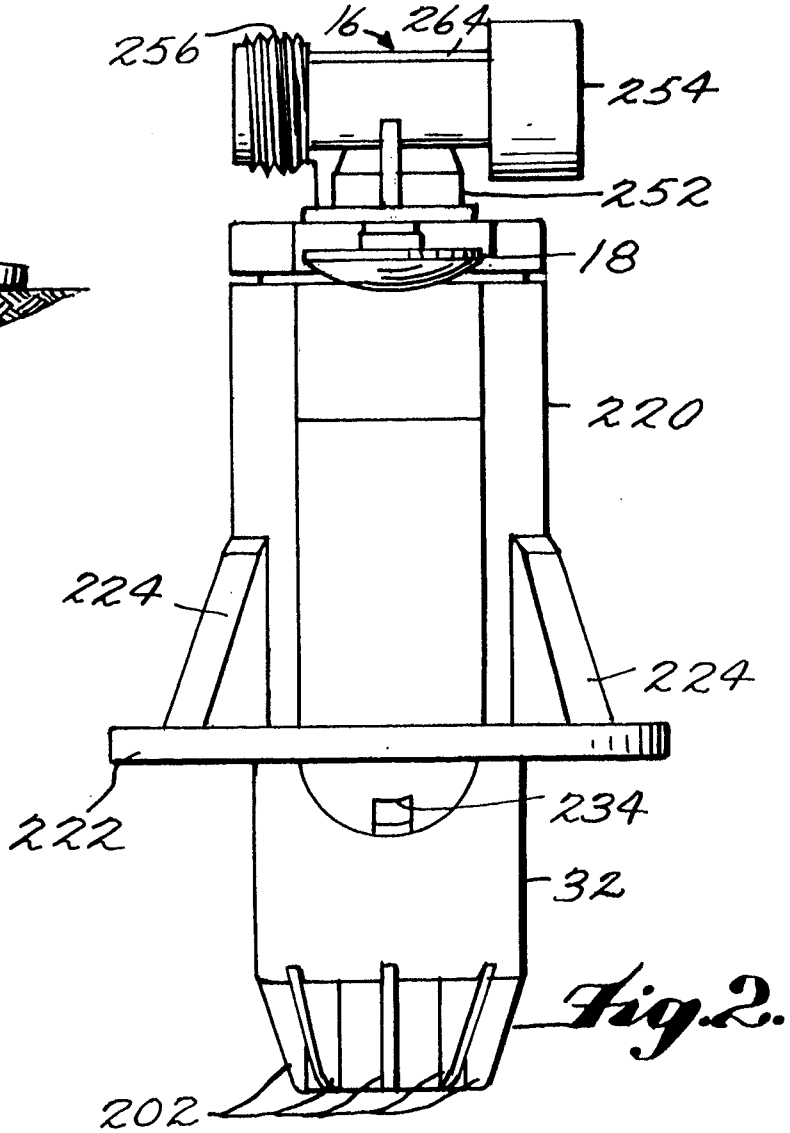
FIG. 2 is a front elevational view of the sprinkler assembly of FIG. 1 connected to a quick connect tee.
Figure 1:
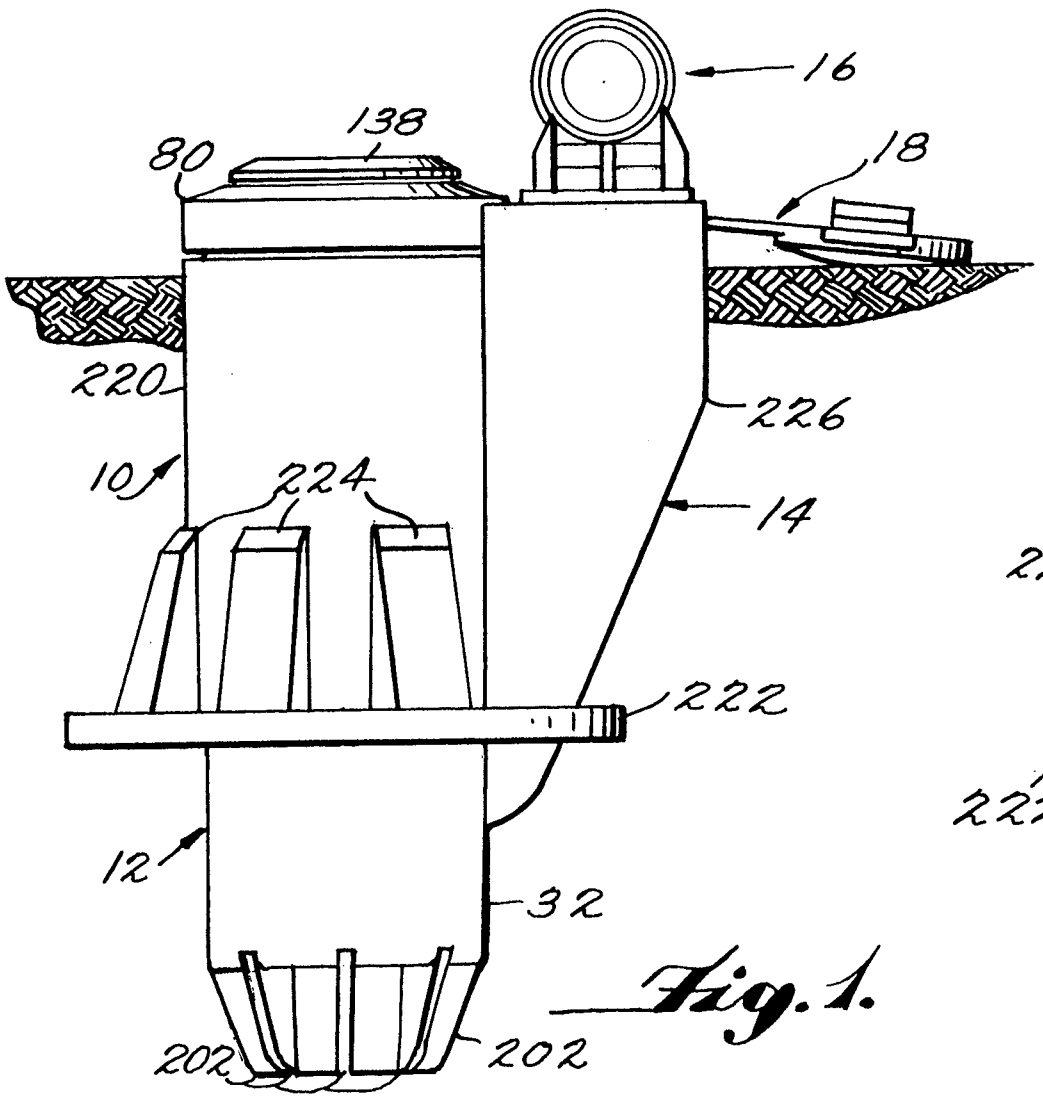
FIG. 1 is a side elevational view of a pop-up sprinkler assembly for installation within the ground and for manual connection from a position above ground with an above ground hose as a source of water under pressure embodying the principles of the present invention, showing the same installed in a lowered storage position.
Figures 3, 3A:
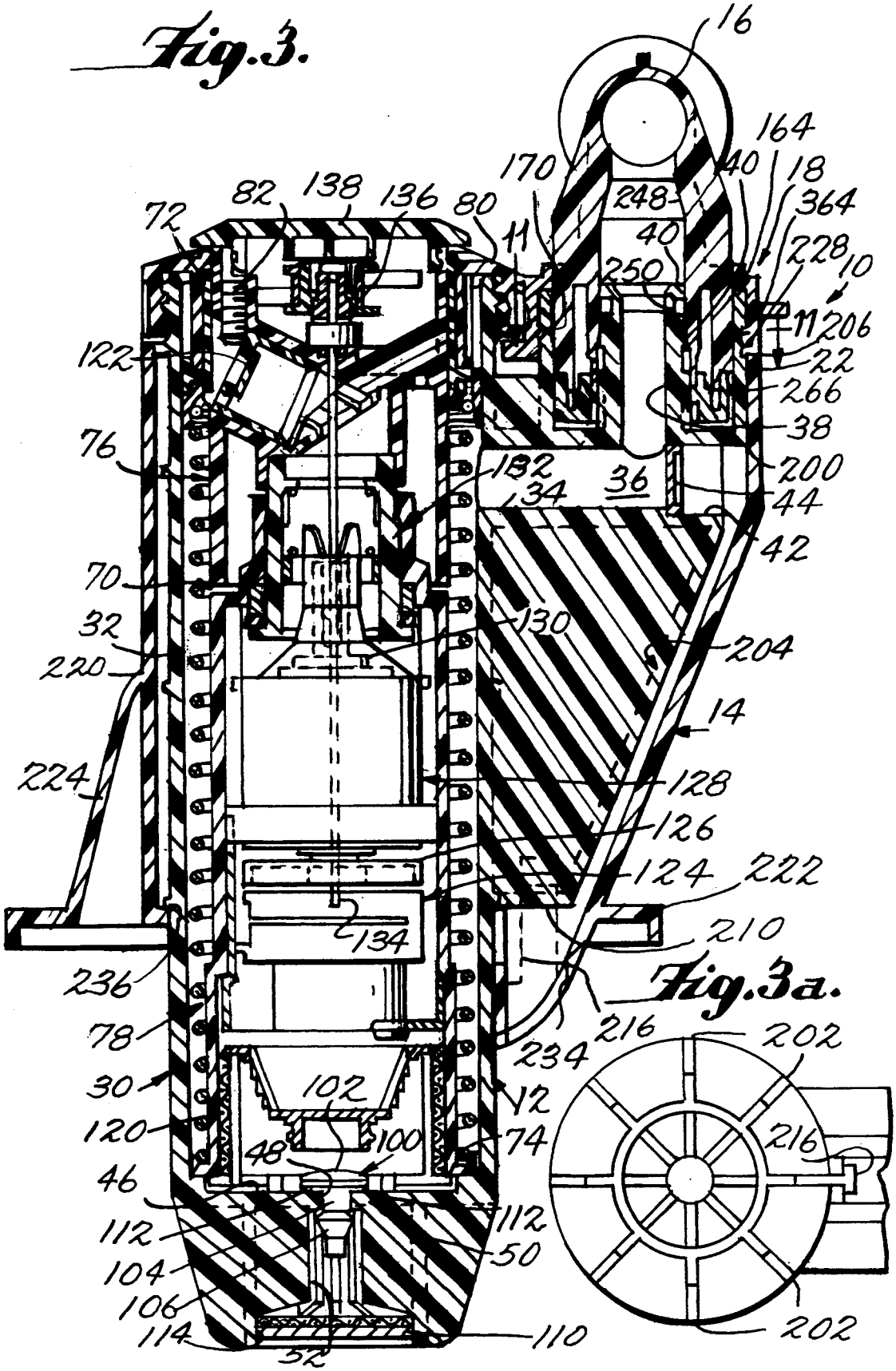
FIG. 3 is a vertical sectional view of the sprinkler assembly in its lowered storage position.
Figure 6:
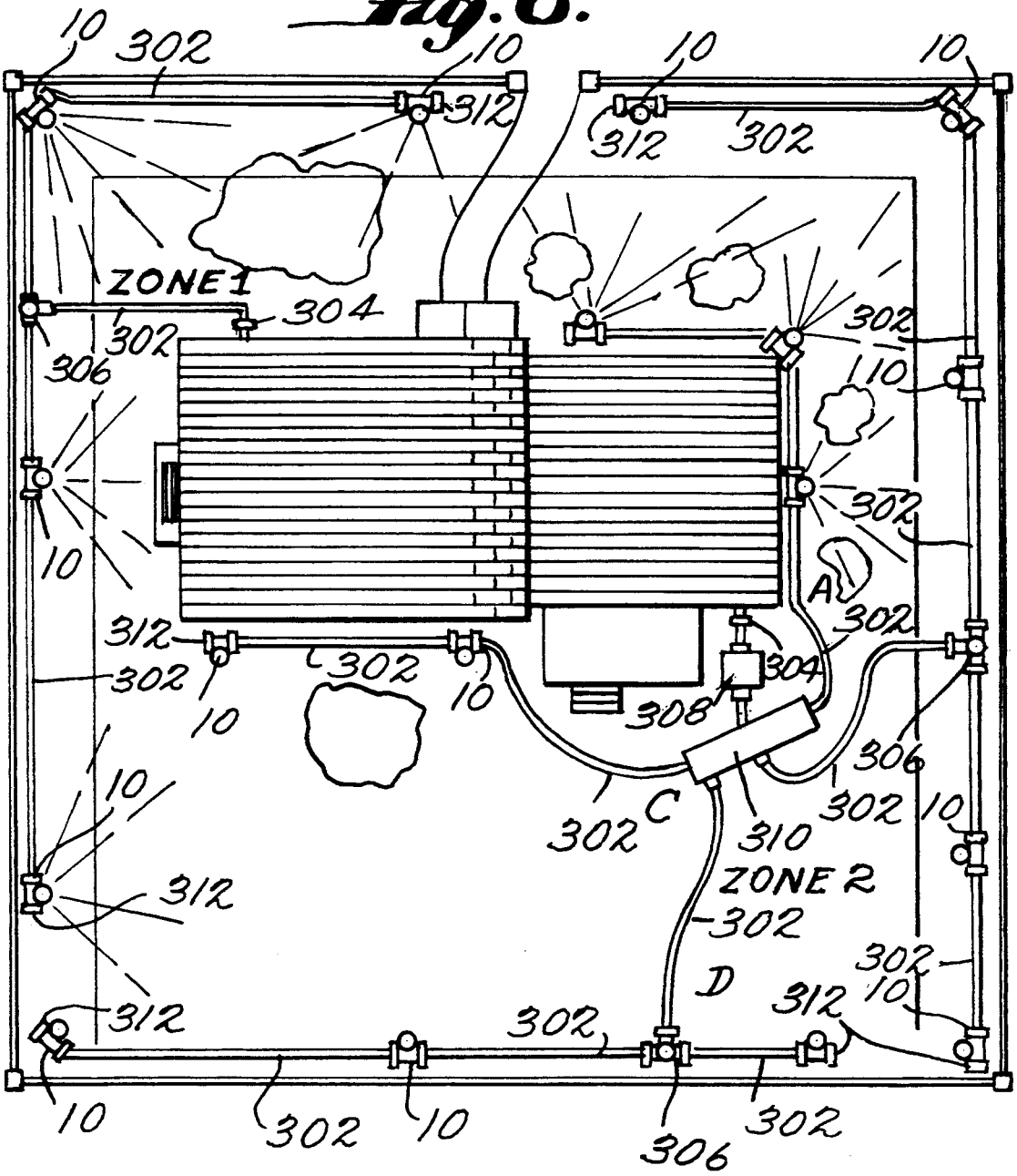
Figure 10:
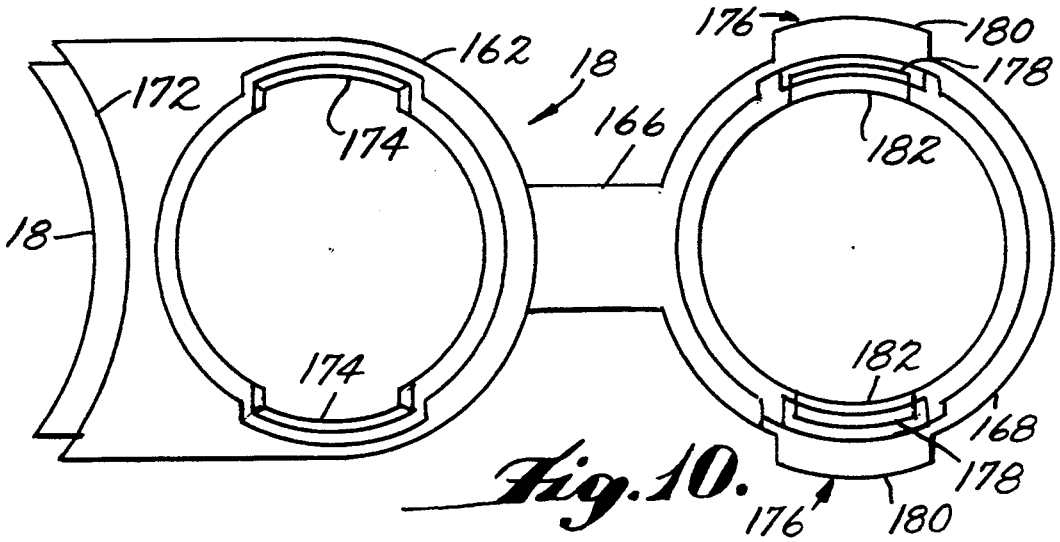
Figure 10A:
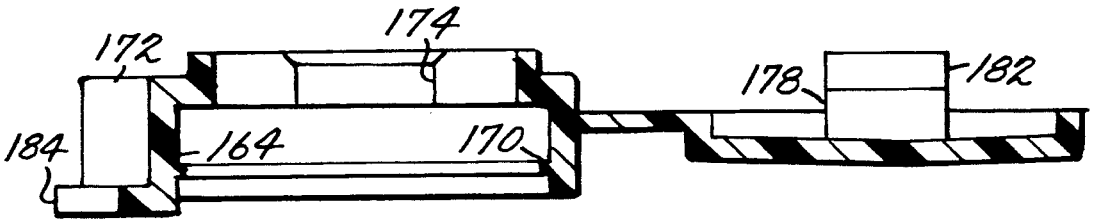

FIG. 3*a* is a partial bottom plan view of the sprinkler assembly of FIG. 3 with the drain filter and drain filter retainer omitted for clarity;

FIG. 4 is a top plan view of the sprinkler assembly of FIG. 2 connected to a quick connect tee;

FIG. 5 is a top plan view of the sprinkler assembly of FIG. 1 with the cap in the closed position;

FIG. 6 is an aerial view of a house with a lawn illustrating the use of the sprinkler assemblies of the present invention;

FIG. 7 is a top plan view of the exterior housing member of FIG. 1;

FIG. 7*a* is a partial side elevational view showing the tabs of the exterior housing member of FIG. 7;

FIG. 8 is a side elevational view of the housing body of FIG. 1;

FIG. 9 is a top plan view of the housing body of FIG. 8;

FIG. 10 is a top plan view of the cap from the sprinkler assembly of FIG. 1;

FIG. 10*a* is a vertical sectional view of the cap of FIG. 10; and

Figure 11:
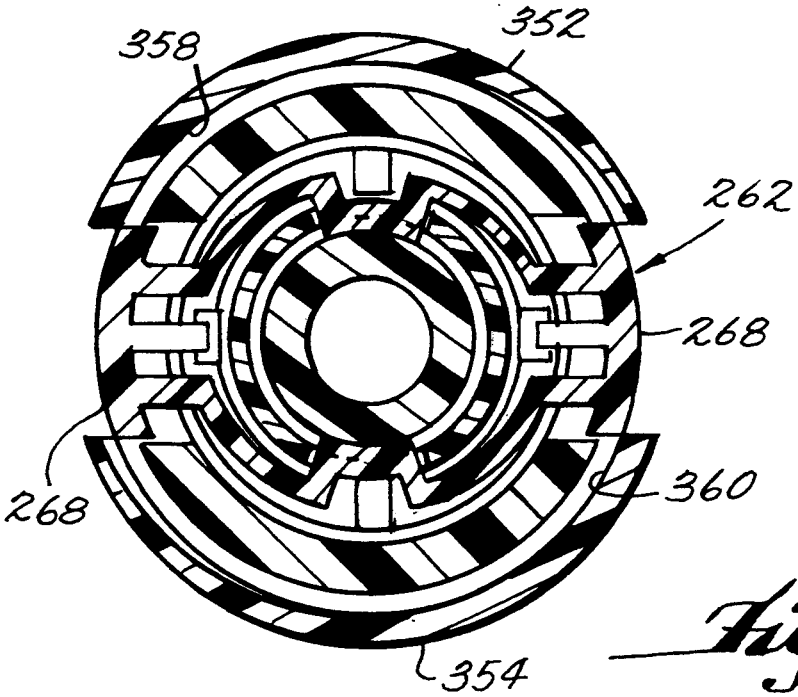

FIG. 11 is a partial sectional view taken along line 11—11 in FIG. 3.

Referring now more particularly to the drawings, and initially to FIG. 1, there will be seen an operative context of the subject invention. More particularly, a pop-up sprinkler assembly, generally indicated at 10, is disclosed for installation within the ground in a fixed operative condition. The sprinkler assembly shown in the drawings is of the internally driven type disclosed in U.S. Pat. No. 4,892,252, entitled "Adjustable Part Circle Sprinkler Assembly," assigned to L.R. Nelson Corporation, the assignee of the present application. It will be understood that the principles of the present invention are equally applicable to other types of pop-up sprinklers included fixed orifice types as well as externally driven sprinklers such as step-by-step rotary sprinklers, among others. The sprinkler assembly 10 is designed for manual connection from a position above ground with an above ground hose as a source of water under pressure.

As shown, the pop-up sprinkler assembly 10, which embodies the principles of the present invention, includes a housing structure, generally indicated at 12, an exterior housing member 14, a hose connection 16 which may be of any known construction capable of being connected in communicating relation with an above ground hose or the like connected with the outlet of a sill cock for communicating the source of water under pressure therein with the interior of the housing structure 12, a sprinkler head assembly 70, and a hingeable cap 18. In FIG. 1, the sprinkler assembly 10 is shown in a lower storage position.

As shown, the housing structure 12 includes a housing body 30 which is of generally tubular configuration and is molded of a suitable plastic material. The tubular portion 32 of the housing structure 30 has an interior defining an annular space which terminates at an upper end thereof with an annular opening. When installed in the ground, in a fixed operative condition, the annular opening of the housing body 30 is disposed generally at ground level with the annular space extending therebelow. The tubular portion 32 is of generally L-shaped configuration having a horizontal leg portion 34 below the annular opening which defines a portion of an inlet passageway 36. Extending upwardly from the horizontal leg portion 34 is a vertical leg portion 38 of the inlet passageway 36. Vertical leg portion 38 has on its exterior a male quick disconnect fitting 40. The housing body 30 includes a bore 42 concentric with horizontal leg portion 34. Into bore 42 is inserted a plug 44 so as to seal inlet passageway 36.

The housing body 30 has a bottom wall 46 integral with tubular portion 32 and a drain opening 48 therein extending downwardly to the exterior of the sprinkler assembly 10. An annular step 50 is formed between a bore 52 located below drain opening 48 and concentric thereto. Partial cylindrical wall sections 84 (see FIG. 9) are concentric to bore 52. Above drain opening 48 is disposed an upper annular portion 102 of valve 100. Extending downwardly from the upper annular portion 102 is a central stem portion 104. A lower retaining portion 106 is attached to central stem portion 104 and is spaced below the drain opening 48. A plurality of annularly spaced depending elements 112 extend downwardly from the upper annular portion 102. Below bore 52 is a larger concentric step 114. Into bore 52 is placed drain filter 108 which is retained by press fit drain filter retainer 110. The annular seal assembly 72 is carried within an annular cap 80 which is threaded onto the upper end of the housing body 30. A set screw 82 serves to retain nozzle 122 to sprinkler head structure 76.

Within the annular space of housing structure 12 is disposed a sprinkler head, generally indicated at 70. Mounted within the upper interior end of the housing structure 12 is an annular seal assembly, generally indicated at 72, which cooperates with the sprinkler head 70 for movement between a lowered storage position, as shown in FIGS. 1–3, and a popped-up operative position (not shown). A coil spring 74 is mounted within the housing structure 12 between the seal assembly 72 and the lower end of the sprinkler head 70 so as to resiliently bias the latter together with the sprinkler head 70 into their lowered storage position.

The sprinkler head 70 includes a sprinkler head structure, generally shown at 76, and a sprinkler body structure, generally shown at 78. The interior of the sprinkler head structure 76, which is mounted for rotational movement on sprinkler head structure 78 in either direction about an upright axis, and the interior of the sprinkler head structure 78 are configured to provide a flow path for the water under pressure which passes through inlet passageway 36 of the housing structure 12. The inlet of the flow path for the sprinkler head 76 is defined by a sieve or screen member 120 in the sprinkler body structure 78 and the outlet is defined by outlet nozzle member 122 within sprinkler head structure 76.

Included within the flow path within the sprinkler body structure 78 is a reversible flow-directing mechanism, generally indicated at 124, which serves to reverse the direction of water flow onto impeller 126. The impeller 126 drives a meshing gear speed reduction assembly, generally indicated at 128, which includes a rotary output member 130 rotatable in a direction commensurate with the direction of the rotation of the impeller 126. The rotary output member 130 is connected by a slip clutch mechanism, generally indicated at 132, with the sprinkler head structure 76, the slip clutch mechanism 132 normally being operable to transmit rotational movements of the rotary output member 130. Mounted within an open upper end of the sprinkler head structure 76 is a part circle pattern control assembly, generally indicated at 136, which is connected through a reversing mechanism, generally indicated at 134, to the reversible flow-directing mechanism 124 in the sprinkler body structure 78. The open upper end of the sprinkler head structure 76 is closed by a removable cap structure, generally indicated at 138.

The details of construction of and the exact mode of operation of the sprinkler head structure 76 including the outlet nozzle member 122, the slip clutch mechanism 132, the part circle pattern control assembly 136 is known as is the sprinkler body structure 78 including the sieve or screen member 120, the reversible flow-directing mechanism 124, the impeller 126, the meshing gear speed reduction assembly 128, rotary output member 130, reversing mechanism 134 and removable cap structure 138, and annular seal assembly 72. An exemplary embodiment similar to the illustrative structures and mechanisms shown is disclosed in detail in U. S. Pat. No. 4,892,252, the disclosure of which is hereby incorporated by reference into the present specification.

The housing body 30 has a mounting portion 200 attached to the upper end thereof and laterally disposed from the annular opening. An upwardly facing male quick disconnect fitting 40 is centrally located on the bottom wall 366 of the mounting portion 200 and is fluidly connected to inlet passageway 36. Surrounding the male quick disconnect fitting 40 are two opposed partial cylindrical wall sections 352, 354 that are integral with the mounting portion 200 and are of approximately equal vertical height with quick disconnect fitting 40. Defined by the partial cylindrical walls 352 and 354 are opposed vertical openings 368 and 370. As shown, cam sections 358 and 360 are diametrically opposed and are formed on partial wall sections 352 and 354 respectively. Extending radially outwardly from quick disconnect fitting 40 and extending upwardly from the bottom wall 366 are four steps 362. Extending through the bottom wall 366 are two pairs of two opposed notches 356. Partial cylindrical wall 354 has an external annular groove 364 below the uppermost surface of partial cylindrical wall 352.

The hingeable cap 18 is mounted above partial cylindrical wall 352 and has a body portion 162, the annular circular interior surface 164 of which is in fitting relationship with the exterior surface of partial cylindrical wall 22. The hingeable cap 18 also includes a cap portion 168 hingeably connected to a body portion 162 by the hinge portion 166. Extending from the interior surface of annular circular portion 162 is an internal annular projection 170 that engages the external annular groove 352 of partial cylindrical wall 22. The hingeable cap 18 includes an arcuate wall 172 that abuts the exterior of the tubular portion 32 of the housing body 30. Extending outwardly from body portion 162 is arcuate step 184. Body portion 162 includes a pair of diametrically opposed recesses 174 for receiving the locking members 176 on cap portion 168. As shown, the locking members 176 are preferably in the form of a pair of opposed arcuate wall sections 178 having ends integrally joined in space relation with a pair of radially outwardly spaced digitally engageable pad sections 180 that constitute unlocking portions of cap portion 162. The arcuate wall sections 178 include ramp sections 182 that are spaced radially outwardly therefrom. The thin-wall construction and plastic material of the hingeable cap 18 is such that the locking member 176 and unlocking member 178 are capable of resilient flexure such that a manual movement of unlocking portions 178 radially toward each other out of their normal positions results in locking portions 176 moving radially toward each other thereby unlocking the cap portion 168 from the body portion 162.

The exterior of the housing body has a series of radially outwardly extending ribs 202 at the lower end thereof. The housing body 30 is provided with an external annular groove 206 in the mounting portion 200, and an external annular groove 214 in the tubular portion 32 of the housing body 30 so that the exterior housing member 14 can be attached by snap action to the housing body 30. The external annular groove is spaced below the external annular groove 364 on the partial cylindrical wall 352. The mounting flange 204 has a T-shaped cross-section which is fixed at its outer periphery, on one end, with the outer surface of the mounting flange 20 and at the opposite end with the tubular portion 32. Mounting flange 204 has a tapered section which tapers inwardly from the mounting flange 20 towards tubular portion 32 and a horizontal section 210 which extends inwardly therefrom. A plurality of external annular portions 212 are vertically spaced on the exterior of the tubular portion 32 of housing body 30.

The exterior housing member 14 is molded of a suitable plastic material. As shown, the exterior housing member 14 includes a tubular portion 220, a flange portion 222, ribs 224 between tubular portion 220 and flange portion 222, and an outwardly directed portion 226. The tubular portion 220 has an arcuate annular portion 228 for engaging external annular groove 206. Extending radially outwardly from the tubular portion 220 is the flange portion 222. A plurality of ribs 224 tapering from tubular portion 220 to flange 222 serve to stiffen the exterior housing member 14. At the lowermost portion of outwardly directed portion 226 are two opposed tabs 230 to be brought into locking engagement with horizontal section 210. Each tab has a ramp section 232 which engages horizontal section 210 causing tabs 230 to bend outwardly so as to allow horizontal section 210 to become fixedly engaged with tabs 230. Lower T-section 216 engages opening 234 preventing exterior housing member 14 from moving horizontally relative to housing body 32. It will be understood that because the sprinkler assembly is to be disposed within a hole in the ground, flange 222 should be preferably located near the bottom of the tubular portion 32 so that the sprinkler assembly is secure and can resist relative upward movement when, for example, quick connect tee 16 is disconnected. Drain opening 234 is located at the lowermost portion of outwardly directed portion 226 allowing water that enters therein to drain therefrom into the ground.

As shown, a fitting such as a quick connect tee 16 can be releasably connected with male quick disconnect fitting 40 from above ground. It will be understood that other fittings such as straight connectors, elbows, crosses among others are similarly suitable. Before the quick connect tee can be connected, the cap portion of hingeable cap 18 must be disengaged from body portion 162 as described heretofore. Quick connect tee 16 includes an annular structure, generally indicated at 248, and a locking/unlocking member generally indicated at 262. The annular structure 248 has a tee member 164 of generally tubular configuration attached to cap member 266 as by sonic welding or the like. Locking/unlocking member 262 has a pair of opposed engageable pad sections 268 constituting unlocking portions of the member 262. The pad sections 268 extend radially outwardly beyond the outside surface of the annular structure 248.

As previously indicated, the quick connect tee 16 is connected to male quick connect 40. Before the connection is made, hingeable cap 18 must be placed in the open position as best shown in FIG. 1. In order to accommodate the pad sections 268 of the locking/unlocking member 262, the hingeable cap is provided with a pair of diametrically opposed recesses 174 through which the pad sections 268 can be extended into when the quick connect tee 16 is being brought into locking engagement with fitting 40. Similarly, diametrically opposed openings 368 and 370 between partial wall sections 352 and 354 provide openings for receiving pad sections 268 when quick connect tee 16 is brought into locking engagement with fitting 40. Once locked into position, 0-ring 250 provides a seal between quick connect fitting 16 and male quick connect 40.

The details of construction of and the exact mode of operation of the quick connect/disconnect mechanism of the quick connect tee 16 and male quick connect fitting 40 are known. An exemplary embodiment similar to the illustrative structures and mechanisms shown is disclosed in detail in U.S. Pat. No. 4,856,823, the disclosure of which is hereby incorporated by reference into the present specification.

When it is desired to release or uncouple the quick connect tee 16 from fitting 40, the operator simply rotates quick connect tee 16 from above ground in the clockwise direction as shown in FIG. 4. This rotational movement causes pad sections 268 to engage with cam sections 358 and 360 so as to gradually effect a relative radial movement of pad sections 268 towards each other. This movement of the pad sections 268 causes the quick connect tee 16 to unlock from fitting 40. In order to remove quick connect tee 16 through hingeable cap 18, the operator must rotate tee 16 counter-clockwise aligning pad sections 268 with recesses 174.

As shown, the quick connect tee has a vertically oriented connecting portion 252 located between a female thread fitting 254 and a male thread fitting 256 which cooperates with male quick connect fitting 40. It will be understood that female thread fitting 254 and male thread fitting 256 are to be connected with the end of a garden hose 302. Alternatively, female thread fitting 254 can be capped with female threaded cap 312.

OPERATION

FIG. 1 illustrates the sprinkler assembly 10 in an installed lowered storage position with hingeable cap 18 detached. FIG. 2 illustrates the sprinkler assembly 10 with quick connect tee 16 installed. It will be understood that each sprinkler assembly 10 becomes operative when manually connected to an above ground hose as a source of water under pressure. Upon connection, the communication of water under pressure with the sprinkler head 10 causes water pressure-biased movement of the sprinkler head 70 from a lower storage position into a raised operative position. The outlet nozzle member 122 is then positioned above ground level when the sprinkler head 70 is in the raised operative position for directing water under pressure outwardly thereof onto the ground in a predetermined manner.

Prior to connecting a source of water under pressure, each sprinkler assembly 10 can be adjusted using part circle pattern control assembly 136 so that the rotary sprinkler head structure 76 can be selectively reversibly rotated through repetitious cycles between first and second arcuate limits or moved in repetitious 360° rotational cycles.

Drain valve 100 operates to allow water within the annular space of the sprinkler body 30 which is under no pressure to drain from the annular space through the drain opening 48 because annularly spaced depending elements 103 retain the valve portion 102 out of closing relation with the drain opening 48. The valve portion 102 prevents water within the annular space which is under pressure from passing through the drain opening 48 by resiliently deflecting downwardly into closing relation to the drain opening 48 when water under pressure is within the annular space.

As shown, FIG. 6 illustrates an exemplary layout of an in-ground sprinkler system, although it will be understood that the use of the present invention is by no means limited to the layout shown. As shown in zone 1, a typical system is illustrated where a series of pop-up sprinkler heads 10 are embedded in the lawn at appropriate locations throughout the lawn area to be sprinkled. Sprinkling in zone 1 is effectuated by manually connecting the sprinkler heads 10 together with hoses 302 which are then connected to a sill cock 304 and the water turned on. As shown, there are two branches to zone 1 which are connected together using a tee 306, although other branches could be formed using conventional plumbing such as 2-way elbows or 4-way crosses.

As shown in zone 2, multiple outlets are connected to a stepping unit and programmable timer, both of which are disclosed in U.S. Pat. No. 4,858,827. It will be understood that in the system shown four outlets are provided although two or more outlets can be provided. By use of multiple outlets, more effective use can be made of each sill cock as any desired number of hoses can be attached to the multiple outlets connected to each sill cock, with each individual hose being serially filled with water on a time share basis so that different areas of the lawn are sprinkled at different times. It should also be noted that the hose in zone A need not be disconnected each time the water is turned off. Appropriate placement of the hose behind bushes and shrubs and under bark and mulch can result in effective concealment of the hose.

The timer 308 can be programmed to turn on and off water flow to the sprinkler heads 10 at various times during the day. The stepping valve 310 is adapted to operate during each cycle of the timer 308 so as to successively communicate between with zones A, B, C, and D as shown.

As shown, different sprinklers in the system would be adjusted to provide different part circle patterns. For example, the sprinklers in the corners would be adjusted to provide a 90° part circle pattern in operation. Sprinklers adjacent to the house and along the boundary of the property would be adjusted to provide a 180° part circle pattern. Sprinklers located at the corners of the house would be adjusted to have a 270° part circle pattern. Likewise, where particular situations are presented, other segmental patterns can be achieved by adjusting the part circle sprinkler.

As shown, the sprinkler assemblies 10 can be connected either in parallel or in series by hoses 302. Although quick connect tee 16 is shown, it will be understood that other conventional connections such as 2-way elbows and 4-way crosses are equally applicable. The quick connect tee 16 can also be converted into an elbow by using a female threaded cap 312. Cap 312 is particularly useful for capping quick connect tee 16 at a terminal sprinkler assembly 10.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

WHAT IS CLAIMED:

1. A pop-up sprinkler assembly for installation within the ground and for manual connection from a position above ground with an above ground hose as a source of water under pressure, said assembly comprising a housing structure having an interior defining an annular space terminating at an upper end thereof with an annular opening and an exterior suitable to enable said housing structure to be installed in the ground in a fixed operative position wherein said annular opening is disposed generally at ground level with the annular space extending therebelow, said housing structure providing an inlet passageway communicating with said annular space below the annular opening thereof and extending therefrom into an access position spaced laterally from said annular opening, a hose connector in said passageway in a position allowing manual access thereto from above ground for enabling an above ground hose to be manually connected therewith from a position above ground so as to communicate a source of water under pressure within the hose with said passageway and said annular space, a sprinkler head mounted in said annular space for movement with respect thereto into a lower storage position and for water pressure-biased movement from said lower storage position into a raised operative position, said sprinkler head having an upper end portion disposed within said annular opening generally at ground level when said sprinkler head is in said lower storage position, and an annular seal between the interior of said housing structure and an exterior of said sprinkler head providing a seal for said annular space at a position above the communication of said passageway therewith so that the communication of water under pressure with said annular space results in the water pressure-biased movement of said sprinkler head from its lower storage position into its raised operative position, said sprinkler head having an inlet communicating with the water under pressure within said annular space and an outlet communicating with said inlet, said outlet being disposed in the upper end portion of said sprinkler head so as to be positioned above ground level when said sprinkler head is in said raised operative position for directing water under pressure outwardly thereof onto the ground in a predetermined pattern.

2. A pop-up sprinkler assembly as defined in claim 1 wherein said sprinkler head includes a rotary member in the upper end portion thereof mounted for rotational movement about a vertical axis, said outlet being disposed in said rotary member and including a nozzle for directing water under pressure communicated therewith into an upwardly and outwardly directed stream.

3. A pop-up sprinkler assembly as defined in claim 2 wherein said sprinkler head includes means operable by water under pressure for effecting movement of the rotary member of said sprinkler head about said vertical axis.

4. A pop-up sprinkler assembly as defined in claim 3 wherein said water under pressure operated means includes an internal water motor assembly driven by water under pressure received in said sprinkler head inlet and an internal reduction gear assembly drivingly connecting said water motor assembly with the rotary member of said sprinkler head.

5. A pop-up sprinkler assembly as defined in claim 3 wherein said sprinkler head includes means for limiting the rotational movement of the rotary member of said sprinkler head between preselected arc limits of rotational movement and means for reversing the direction of rotational movement of said water motor assembly so that the rotary member of said sprinkler head moves in repetitious cycles between said limits wherein each cycle includes a movement in one direction from a first limit to a second limit and a movement in an opposite direction from said second limit to said first limit.

6. A pop-up sprinkler assembly as defined in claim 5 wherein said sprinkler head includes means for selectively enabling the rotary member of said sprinkler head to (1) move through said repetitious cycles or (2) move in one direction through repetitious 360° rotational cycles.

7. A pop-up sprinkler assembly as defined in claim 6 wherein said sprinkler head includes means for selectively adjusting (1) the arcuate extent between the first and second limits and (2) the positions within a 360° extent of rotational movement of the rotary member of said sprinkler head where the first and second limits occur.

8. A pop-up sprinkler assembly as defined in claim 7 wherein the hose connector is a first quick-connect-quick-disconnect fitting disposed in a position to cooperate with a cooperating second quick-connect-quick-disconnect fitting from a position above ground.

9. A pop-up sprinkler assembly as defined in claim 8 wherein said housing structure includes means disposed laterally outwardly of said first quick-connect-quick-disconnect fitting for detachably receiving a cap and a cap having securing means cooperating with said receiving means so that said cap can be selectively (1) secured in closing relation with said first quick-connect-quick disconnect fitting and (2) detached from said secured closing relation for enabling said first quick-connect-quick-disconnect fitting to cooperate with said second cooperating quick-connect-quick-disconnect fitting.

10. A pop-up sprinkler assembly as defined in claim 9 wherein said cooperating second quick-connect-quick-disconnect fitting is provided on a stem outlet of a tee-shaped tube having a cross inlet with a female thread fitting for receiving a male thread fitting on the end of the above ground hose and a cross outlet with a male thread fitting for receiving selectively (1) a female thread fitting on the end of a second above ground hose or (2) a female thread cap.

11. A pop-up sprinkler assembly as defined in claim 10 wherein said housing structure includes a fixed annular wall defining said annular space having a hollow tubular portion integral therewith near an upper end of said annular wall defining said inlet passageway communicating with said annular space.

12. A pop-up sprinkler assembly as defined in claim 11 wherein said tubular portion is of generally L-shaped configuration having a horizontal leg portion extending outwardly from said annular wall defining a portion of the inlet passageway which communicates with said annular space and a vertical leg portion extending upwardly from said horizontal leg portion within which said first quick-connect-quick-disconnect fitting is embodied, said vertical leg portion having vertical notches located radially outwardly from said first quick-connect-quick-disconnect fitting to allow water to drain therethrough.

13. A pop-up sprinkler assembly as defined in claim 12 wherein said housing structure includes a separate exterior housing member extending around said annular wall and said tubular portion and fixed thereto, said separate exterior housing member including an annular flange for facilitating the inground installation of said housing assembly, said separate exterior housing member including a drain opening therein for allowing water which enters said exterior housing member to drain therethrough.

14. A pop-up sprinkler assembly as defined in claim 13 wherein said separate exterior housing member is fixed to said annular wall by a snap action connection assembly operable to effect the fixed connection in response to a relative upward movement of said exterior housing member with respect to said annular wall into a connected position wherein said exterior housing member extends around said annular wall and said tubular portion.

15. A pop-up sprinkler assembly as defined in claim 14 wherein said housing structure includes a bottom wall integral with said annular wall, said bottom wall having a drain opening therein and a valve in said drain opening operable (1) to allow water within said annular space which is under no pressure to drain from said annular space through said drain opening and (2) to prevent water within said annular space which is under pressure from passing through said drain opening.

16. A pop-up sprinkler assembly as defined in claim 15 wherein said valve comprises a body of resilient material having an upper annular valve portion, a central stem portion extending downwardly from said upper valve portion through said drain opening in non-closing relation thereto, and a lower retaining portion on a lower end of said stem portion spaced below said drain opening, said valve portion including annularly spaced depending elements for retaining said valve portion out of closing relation with said drain opening when there is no water under pressure within said annular space, said valve portion being resiliently deflected downwardly into closing relation to said drain opening when water under pressure is within said annular space.

17. A pop-up sprinkler as defined in claim 8 wherein said first quick-connect-quick-disconnect is a male quick connect fitting.

18. A pop-up sprinkler as defined in claim 17 wherein said cooperating second quick-connect-quick-disconnect fitting is a female quick connect fitting having a coupling end to receive said male quick connect fitting and an opposite end adapted to be connected to at least one hose, said coupling end having a generally cylindrical exterior and a pair of diametrically opposed locking-/unlocking members disposed radially outwardly therefrom.

19. A pop-up sprinkler as defined in claim 18 wherein said housing structure has a generally cylindrical structure disposed radially outwardly from said hose connector and having vertical notches suitable for receiving said locking/unlocking members when said fittings are connected together wherein when said female fitting is rotated from said end adapted to be connected to at least one hose said locking/unlocking members are brought into engagement with said cylindrical structure whereby said male and female fittings are disconnected from each other.

20. A sprinkler system having a plurality of sprinkler assemblies for installation within the ground and for manual connection from a position above ground with an above ground hose as a source of water under pressure in which said plurality of sprinkler assemblies are fluidly interconnectable, said system comprising a housing structure for each respective sprinkler assembly having an interior defining an annular space terminating at an upper end thereof with an annular opening and an exterior suitable to enable said housing structure to be installed in the ground in a fixed operative position wherein said annular opening is disposed generally at ground level with the annular space extending therebelow, said housing structure providing an inlet passageway communicating with said annular space below the annular opening thereof and extending therefrom into an access position spaced laterally from said annular opening, a hose connector for each respective sprinkler assembly in said passageway in a position allowing manual access thereto from above ground for enabling an above ground hose to be manually connected therewith from a position above ground so as to communicate a source of water under pressure within the hose with said passageway and said annular space, a sprinkler head for each respective sprinkler assembly mounted in said annular space for movement with respect thereto into a lower storage position and for water pressure-biased movement from said lower storage position into a raised operative position, said sprinkler head having an upper end portion disposed within said annular opening generally at ground level when said sprinkler head is in said lower storage position, and an annular seal for each respective sprinkler assembly between the interior of said housing structure and an exterior of said sprinkler head providing a seal for said annular space at a position above the communication of said passageway therewith so that the communication of water under pressure with said annular space results in the water pressure-biased movement of said sprinkler head from its lower storage position into its raised operative position, said sprinkler head having an inlet communicating with the water under pressure within said annular space and an outlet communicating with said inlet, said outlet being disposed in the upper end portion of said sprinkler head so as to be positioned above ground level when said sprinkler head is in said raised operative position for directing water under pressure outwardly thereof onto the ground in a predetermined pattern.

21. An automatic sprinkler system having an automatic timer and a stepping valve for automatically distributing water under pressure from a sill cock to one of a plurality of hoses each having a plurality of sprinkler assemblies connected thereto, said plurality of sprinkler assemblies for installation within the ground and for manual connection from a position above ground with one of said plurality of hoses as a source of water under pressure, said automatic sprinkler system comprising programming means for selecting a sprinkling time in the future when it is desired to water valve means fluidly connected to the sill cock and operable in response to an electrical signal from said programming means and movable into opened and closed position with respect thereto so as to permit and prevent respectively communication of the water under pressure from the sill cock to one of a plurality of hoses each having a plurality of sprinkler assemblies connected thereto means operable to distribute water under pressure from the sill cock when said valve means receives said signal from said programming means causing said distributing means to distribute water under pressure to said one of a plurality of hoses a housing structure for each respective sprinkler assembly in said plurality of sprinkler assemblies, said housing structure having an interior defining an annular space terminating at an upper end thereof with an annular opening and an exterior suitable to enable said housing structure to be installed in the ground in a fixed operative position wherein said annular opening is disposed generally at ground level with the annular space extending therebelow, said housing structure providing an inlet passageway communicating with said annular space below the annular opening thereof and extending therefrom into an access position spaced laterally from said annular opening, a hose connector for each respective sprinkler assembly in said plurality of sprinkler assemblies, said hose connector in said passageway in a position allowing manual access thereto from above ground for enabling one of said plurality of hoses to be manually connected therewith from a position above ground so as to communicate a source of water under pressure within the hose with said passageway and said annular space, a sprinkler head for each respective sprinkler assembly in said plurality of sprinkler assemblies, said sprinkler head mounted in said annular space for movement with respect thereto into a lower storage position and for water pressure-biased movement from said lower storage position into a raised operative position, said sprinkler head having an upper end portion disposed within said annular opening generally at ground level when said sprinkler head is in said lower storage position, and an annular seal for each respective sprinkler assembly in said plurality of sprinkler assemblies, said annular seal between the interior of said housing structure and an exterior of said sprinkler head providing a seal for said annular space at a position above the communication of said passageway therewith so that the communication of water under pressure with said annular space results in the water pressure-biased movement of said sprinkler head from its lower storage position into its raised operative position, said sprinkler head having an inlet communicating with the water under pressure within said annular space and an outlet communicating with said inlet, said outlet being disposed in the upper end portion of said sprinkler head so as to be positioned above ground level when said sprinkler head is in said raised operative position for directing water under pressure outwardly thereof onto the ground in a predetermined pattern.

22. A pop-up sprinkler assembly for installation within the ground and for manual connection from a position above ground with an above ground source of water under pressure, said assembly comprising a housing structure having an interior defining an annular space terminating at an upper end thereof with an annular opening and an exterior suitable to enable said housing structure to be installed in the ground in a fixed operative position wherein said annular opening is disposed generally at ground level with the annular space extending therebelow, said housing structure providing an inlet passageway communicating with said annular space below the annular opening thereof, a connector in said passageway in a position allowing manual access thereto from above ground for enabling an above ground source of water under pressure to be manually connected therewith from a position above ground so as to communicate the source of water under pressure with said passageway and said annular space, a sprinkler head mounted in said annular space for movement with respect thereto into a lower storage position and for water pressure-biased movement from said lower storage position into a raised operative position, said sprinkler head having an upper end portion disposed within said annular opening generally at ground level when said sprinkler head is in said lower storage position, and an annular seal between the interior of said housing structure and an exterior of said sprinkler head providing a seal for said annular space at a position above the communication of said passageway therewith so that the communication of water under pressure with said annular space results in the water pressure-biased movement of said sprinkler head from its lower storage position into its raised operative position, said sprinkler head having an inlet communicating with the water under pressure within said annular space and an outlet communicating with said inlet, said outlet being disposed in the upper end portion of said sprinkler head so as to be positioned above ground level when said sprinkler head is in said raised operative position for directing water under pressure outwardly thereof onto the ground in a predetermined pattern.

* * * * *